United States Patent [19]

Broyles

[11] 4,193,477

[45] Mar. 18, 1980

[54] LADDER STRUCTURE

[75] Inventor: Wayne R. Broyles, Elkhart, Ind.

[73] Assignee: Ronald A. Minichillo, Elkhart, Ind. ; a part interest

[21] Appl. No.: 945,434

[22] Filed: Sep. 25, 1978

[51] Int. Cl.[2] ..... E06C 5/02; E06C 7/08

[52] U.S. Cl. ..... 182/194; 182/93; 182/228

[58] Field of Search ..... 182/228, 194, 215, 220, 182/46, 206, 93; 256/59, 22, 21

[56] References Cited

U.S. PATENT DOCUMENTS

| | | | |
|---|---|---|---|
| 600,730 | 3/1898 | Lincoln | 182/228 |
| 3,944,024 | 3/1976 | Adas | 182/228 |
| 3,964,572 | 6/1976 | Gannon | 182/228 |

FOREIGN PATENT DOCUMENTS

| | | | |
|---|---|---|---|
| 1919643 | 11/1970 | Fed. Rep. of Germany | 182/228 |

*Primary Examiner*—Reinaldo P. Machado
*Attorney, Agent, or Firm*—Marmaduke A. Hobbs

[57] ABSTRACT

A ladder structure in which a plurality of extruded aluminum steps are secured to spaced, vertically disposed side rails, the rails seating in slots in the ends of the step. The slots are closed by end caps, and a screw extends through the end cap and rail into a screw receiving recess in the step. The step contains two laterally disposed screw receiving recesses, and screws extend through the cap into those laterally disposed recesses and, along with the first screw, secure the caps firmly on the end of the step and the step firmly in place on the side rails. The ladder has particular application to vehicles such as motor homes, vans, campers, pickup campers and boats, as well as other uses where the ladder is permanently installed.

7 Claims, 7 Drawing Figures

LADDER STRUCTURE

Permanent ladders used on boats such as cabin cruisers and on recreational vehicles such as campers, motor homes and vans, often consist of two parallel metal bars or rails with a series of spaced wooden steps mounted on the rails by slipping the rails through holes near the ends of the steps. They are then secured in place by pins extending through the sides of the steps and through the rails in the holes. This type of ladder structure is difficult and time consuming to assemble, and hence is relatively expensive to fabricate and is difficult to repair if one of the steps is broken or otherwise damaged. Other types of ladder structures have been designed and constructed for the foregoing uses, but most of these have had a number of inherent difficulties, including problems in fabrication, safety, durability and reliability. It is therefore one of the principal objects of the present invention to provide a ladder structure having parallel tubular metal rails and metal steps which can be individually assembled on and removed from the structure without interference from or disturbance of the other steps in the structure, and which can be conveniently assembled to form a strong, durable and rigid ladder structure.

Another object of the invention is to provide a ladder structure which is attractive in appearance and safe to use under various adverse weather and environmental conditions, and which can be readily adapted to a variety of different makes and models of boats and recreational vehicles.

Still another object of the invention is to provide in a ladder a joint structure for connecting the ends of the steps to vertical tubular metal rails, in which the steps can be individually mounted and secured in place as the ladder is assembled, and which holds the step firmly in place on the rails.

A further object is to provide a ladder structure of the aforementioned type, which is simple in construction, and which can be shipped and stored in a compact, disassembled condition and then easily assembled into a complete ladder, using only a screw driver in the assembly operation.

Additional objects and advantages of the present ladder structure will become apparent from the following description and accompanying drawings, wherein.

Referring more specifically to the drawings, numeral 10 indicates generally a ladder embodying the present invention and showing it mounted on the rear end of a van 12 for use in reaching a luggage or cargo rack 14 on top of the van. The ladder structure is capable of being readily adapted to a variety of different uses, such as on campers, pickup campers, motor homes, and other RV vehicles, and on boats and docks, and for other purposes where a light, strong ladder is required and can be permanently installed on a supporting structure. The ladder can be made and used in a number of different lengths, with the spacing of the steps remaining the same for the various lengths, or the spacing between the steps can be varied from one installation to another to satisfy special requirements. The ladder can be adapted to a variety of other different uses and applications without changing the basic structure thereof.

Figure 1:
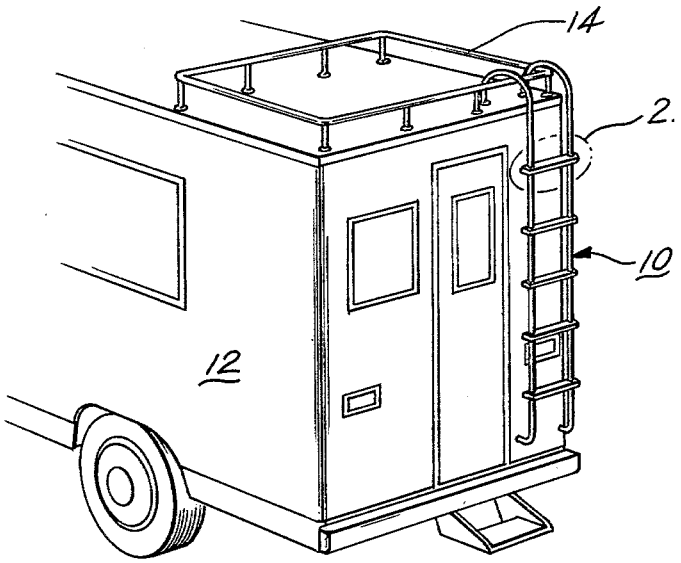
FIG. 1 is a perspective view of the rear end of a van showing the present ladder structure mounted thereon.
Figure 2:
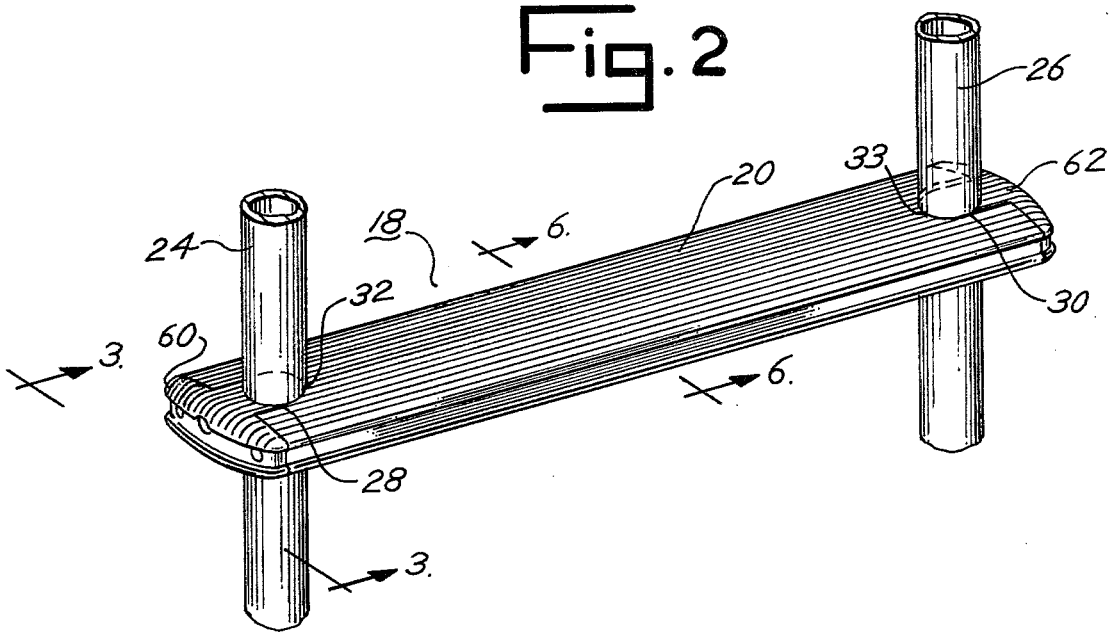
FIG. 2 is an enlarged perspective view of a portion of the ladder, the portion indicated by a circle identified by numeral 2 in FIG 1.
Figure 3:
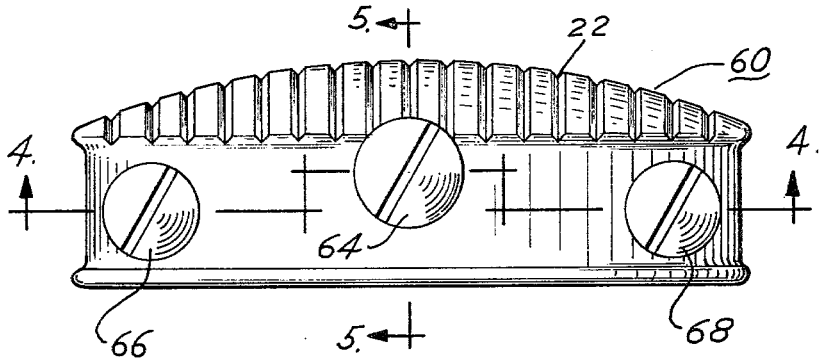
FIG. 3 is an end elevational view of the ladder step shown in FIG. 2.
Figure 4:
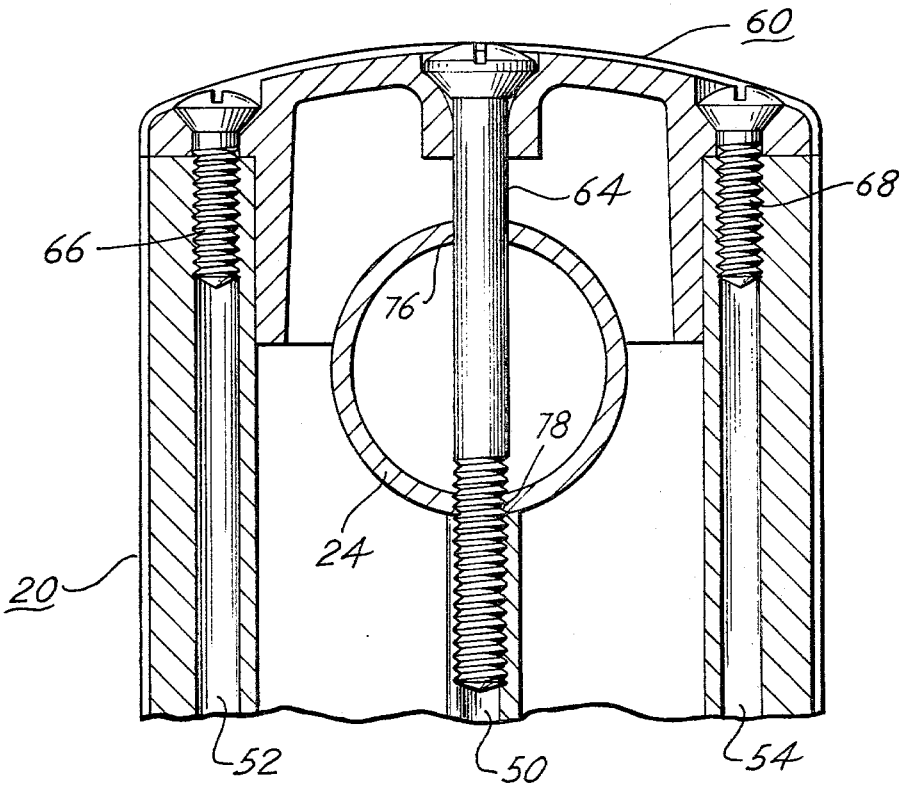
FIG. 4 is a fragmentary, horizontal cross sectional view of the ladder section shown in FIG. 2, the section being taken on line 4—4 of FIG. 3.
Figure 5:
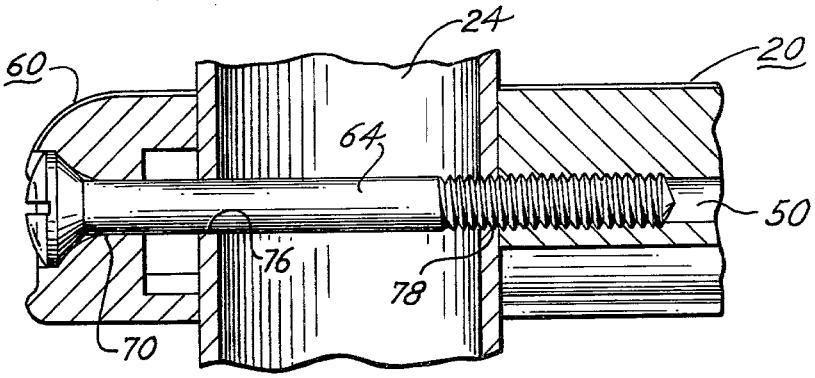
FIG. 5 is a vertical cross sectional view of the ladder structure, the section being taken on line 5—5 of FIG. 3.
Figure 6:
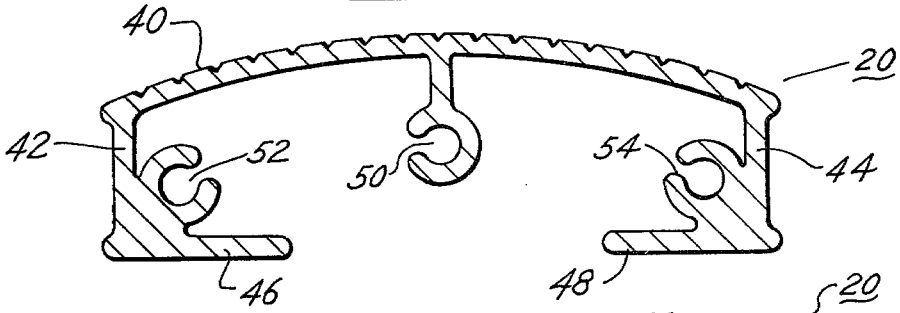
FIG. 6 is cross sectional view of the principal section of the ladder step, taken on line 6—6 of FIG. 2.
Figure 7:
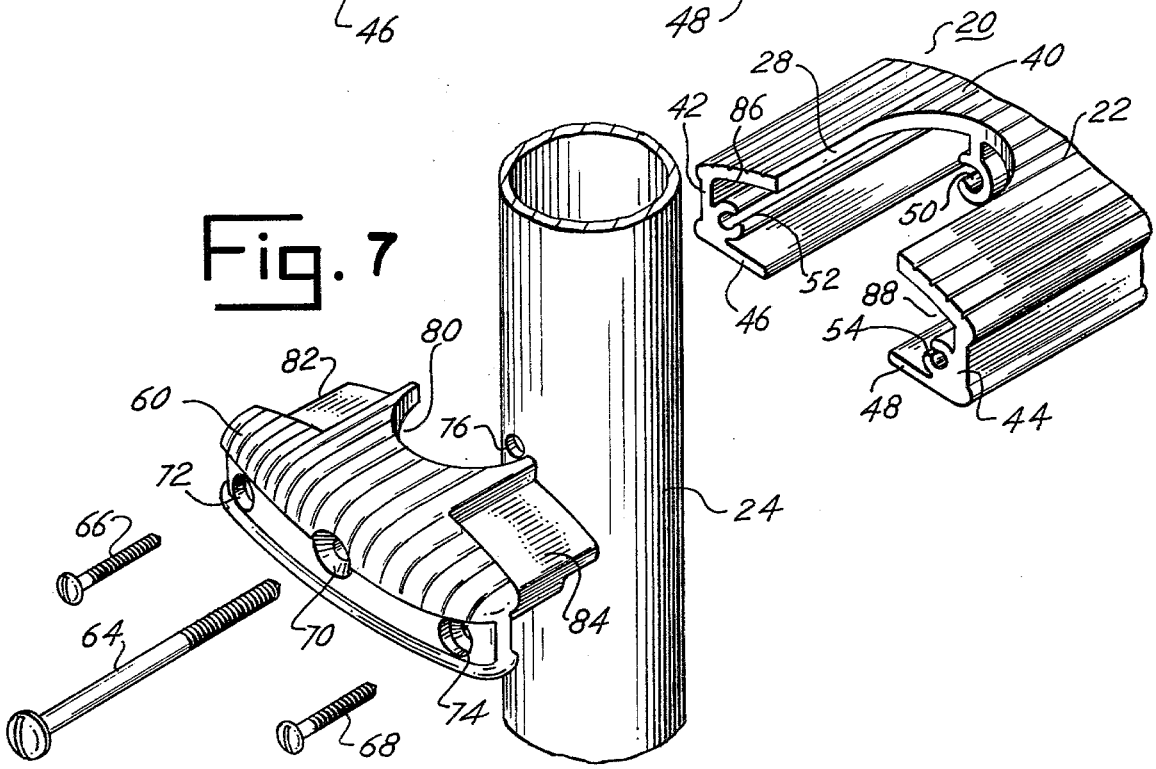
FIG. 7 is a fragmentary, exploded perspective view of the principal parts of the joint structure of the ladder shown in the preceding figures.

The ladder structure involving the present invention as illustrated in the fully assembled form in FIGS. 1 and 2, consists of a plurality of step units 18 each having a step 20, preferably of extruded aluminum alloy material, and preferably having a series of grooves 22 or other type of configuration to improve the traction and minimize slippage of the foot when the ladder is being used. The step is supported by two vertical tubular shaped rails 24 and 26 which fit into longitudinal slots 28 and 30 in opposite ends of the step, the rails preferably being of extruded aluminum tubing; however, other suitable materials may be used. The slots are substantially the same diameter as the rails and have the same radius at their inner ends 32 and 33 so that the rails will seat snugly in the inner ends of the slots. The step 20 has a top 40 and two sides 42 and 44 and flanges 46 and 48, all of which are extruded as a single piece, along with a longitudinal center screw recess 50 and lateral screw receiving recesses 52 and 54. The purposes of these screw receiving recesses will be more fully described hereinafter. The side walls and flanges provide additional strength and stability to the step after it has been secured to the two rails 24 and 26.

When step 20 is assembled on the rails with the rails disposed in the inner ends of slots 28 and 30, end members or caps 60 and 62 are secured to the two rails 24 and 26 and to the respective ends of step 20 by screws 64, 66 and 68 extending through holes 70, 72 and 74 in the caps. Since the two caps are of the same construction, like numerals will be applied to like parts. Screw 64 extends through holes 76 and 78 in opposite sides of the respective rail and is threadedly received in screw receiving recess 50. Screws 66 and 68 extend through holes 72 and 74 and seat in screw receiving recesses 52 and 54. The three screws are self tapping and form the threads in the respective recesses when they are inserted therein as the cap is assembled on the ladder structure.

The cap 60 is provided with a recess 80 which, together with rounded end 32 or 33 of the respective slots 28 or 30, firmly embraces the respective rail. When the step is assembled on the rail, shoulders 82 and 84 seat in slots 86 and 88, respectively, of the step to form a firm structure for retaining the cap in place on the end of the step and retaining the step rigidly in place on the two rails. The caps 60 and 62 may be made of die cast aluminum or of plastic or other suitable material.

In the assembly and operation of the present ladder structure, a series of steps 20 are assembled on the two side rails 24 and 26 at the points where holes 76 and 78 have been drilled. With the rails seated in the inner ends of slots 28 and 30 of the steps, caps 60 and 62 are secured to the opposite ends of the steps by screws 64, 66 and 68, screw 68 extending through hole 70 in the caps and through the respective side rails, into recess 50 where it taps the recess walls to provide the threads for the screw. Screws 66 and 68 extend through holes 72 and 74 and into screw receiving recesses 52 and 54 where they tap the wall of the recess to form the threads for securing the two screws in place. When the three screws 64, 66 and 68 are assembled in the manner indicated, and tightened, cap 60 is secured firmly in place and the cap and screws hold the step 20 rigidly in position on the rails. Screw 64 provides adequate support for the step, and for anyone stepping on the step after the ladder step section has been secured in place in the manner described. When seated in slots 86 and 88, shoulders 82 and 84 assist in maintaining the step in a level position, with the upper surface thereof at substantially right angles with respect to the axis of the two rails. Any number of steps can be used, depending on the length of ladder desired, and each step structure is assembled in the manner described. Thus when the ladder has been completed, a rigid structure results, which can effectively support itself and someone using it without any additional supports between the top and bottom of the ladder.

It is seen that the present ladder structure can be shipped in a disassembled condition and readily assembled into a permanent rigid structure, and the steps can be inserted at various places along the ladder so that it is not necessary to slip the steps longitudinally onto the rails to assemble the ladder structure. In assembling the ladder, all of the steps can be attached to one rail and then to the other, or each step can be attached to both rails at the same time as the ladder is assembled. If at any time any one of the steps of the ladder should be damaged, it can readily be replaced without disturbing the other steps on the ladder, and, in the event the ladder is to be removed, and either stored or shipped, it can readily be disassembled by removing the three screws at each end of each step.

While only one embodiment of the present ladder structure has been described in detail herein, various changes and modifications may be made without departing from the scope of the invention.

I claim:

1. A ladder structure comprising two spaced, vertical side rails, a plurality of vertically spaced step units mounted on said side rails, each step unit including a horizontally disposed step having longitudinal slots extending inwardly from each end of said step for receiving said side rails and having downwardly extending side walls and inwardly extending flanges at the lower edge thereof forming laterally spaced grooves, separate end caps on the ends of said step for closing the ends of said slots, each of said end caps having portions for seating in said grooves when said caps are secured to the ends of said step, and screw means extending through the respective side rails and into said step to secure said step to said side rails.

2. A ladder structure as defined in claim 1 in which said step is constructed of extruded aluminum and contains a screw recess near the longitudinal center of the step, and said screw means extends through the respective end cap and through the respective rail into one of said screw recesses.

3. A ladder structure as defined in claim 2 in which said step includes two laterally disposed screw recesses and screws extend through said end caps into said laterally disposed screw recesses.

4. A ladder structure as defined in claim 1 in which said rails are of a round tubular structure and said slots in the end of said step have rounded inner ends in which the respective rails seat, and said end caps have rounded slots for engaging said rails when said screw means is inserted through said rail and into said step.

5. A ladder structure as defined in claim 3 in which said rails are of a round tubular structure and said slots in the end of said step have rounded inner ends in which the respective rails seat, and said end caps have rounded slots for engaging said rails when said screw means is inserted through said rail and into said step.

6. A step unit for a ladder having two spaced vertical side rails: comprising a horizontally disposed step having longitudinal slots extending inwardly from each end of said step for receiving said rails and having downwardly extending side walls and inwardly extending flanges at the lower edge thereof forming laterally spaced grooves, separate end caps on the ends of said step for closing the end of said slots, each of said end caps having portions for seating in said grooves when said cap is secured to the ends of said step and screw means extending through said end caps and said slots and into the respective ends of said step for securing said step and end caps to said side rails.

7. A step unit for a ladder as defined in claim 6 in which said step is of extruded aluminum and has a longitudinally extended, center screw receiving recess and two laterally located screw receiving recesses, said screw means extending through said end cap and the respective rail into said center screw receiving recess, and laterally disposed screws extending through said end cap into said laterally located screw recesses.

* * * * *